United States Patent [19]

Wolff et al.

[11] Patent Number: 4,898,811

[45] Date of Patent: Feb. 6, 1990

[54] COLOR PHOTOGRAPHIC SILVER HALIDE MATERIAL WITH SULFONYLPHENOL OIL FORMER

[75] Inventors: Erich Wolff, Solingen; Dieter Lowski, Bergheim; Harry Elias, Leverkusen, all of Fed. Rep. of Germany

[73] Assignee: Agfa-Gevaert Aktiengesellschaft, Leverkusen, Fed. Rep. of Germany

[21] Appl. No.: 279,415

[22] Filed: Dec. 2, 1988

[30] Foreign Application Priority Data

Dec. 18, 1987 [DE] Fed. Rep. of Germany ..... 3743006

[51] Int. Cl.[4] ..... G03C 7/38

[52] U.S. Cl. ..... 430/546; 430/551; 430/558

[58] Field of Search ..... 430/546, 551, 558 R

[56] References Cited

U.S. PATENT DOCUMENTS

| | | | |
|---|---|---|---|
| 4,207,393 | 6/1980 | Snyder | 430/546 |
| 4,363,873 | 9/1981 | Boon et al. | 430/546 |
| 4,513,082 | 4/1985 | Furutachi et al. | 430/558 |
| 4,562,146 | 12/1985 | Masuda et al. | 430/546 |
| 4,774,166 | 9/1988 | Sasaki et al. | 430/546 |

*Primary Examiner*—Richard L. Schilling
*Attorney, Agent, or Firm*—Connolly & Hutz

[57] ABSTRACT

A color photographic silver halide material which, in at least one silver halide emulsion layer, contains a magenta coupler corresponding to formula I or (II) below (I)

(II)

in which $R_1$ represents alkyl, aryl or a ballast group, $R_2$ represents a ballast group, alkyl or aryl, Z represents hydrogen or a group releasable on reaction with the developer oxidation product, and a compound corresponding to formula (III)

(III)

in which $R_3$ represents alkyl, alkoxy, aryl, optionally substituted amino or the residue of a heterocycle, $R_4$ represents $COR_5$, $NHR_6$, $S(O)_nR_7$, $K_5$ represents $OR_8$, $NHR_8$, alkyl, aryl or a heterocycle, $R_6$ represents $SO_2R_8$, $COR_8$ or $CONHR_8$, $R_7$ represents alkyl, aryl or $NHR_3$, $R_8$ represents alkyl or aryl and n=0, 1 or 2, with the exception of compounds in which $R_3$ is a carboxymethoxyphenyl, carboxymethoxy, alkoxycarbonylmethoxy or alkoxycarbonylmethoxyphyl radical substituted at the methylene group.

5 Claims, No Drawings

COLOR PHOTOGRAPHIC SILVER HALIDE MATERIAL WITH SULFONYLPHENOL OIL FORMER

This invention relates to a color photographic silver halide material of high sensitivity and high color density which shows good spectral absorption properties, particularly in the magenta range.

In color photography based on photosensitive silver halides, the colors yellow, magenta and cyan are formed by reaction of the developer oxidation product with the corresponding couplers. Pyrazolone compounds are normally used as the magenta couplers, although they present numerous problems. First, they show undesirable absorption in the 400 to 500 nm wavelength range in addition to the desired and predominant absorption in the 540 to 560 nm range. Second, the dyes produced with these couplers show low maximal color density. Third, the long-term stability of these couplers is unsatisfactory because, in the event of prolonged storage, particularly in the presence of even the slightest quantities of formaldehyde, unexposed photographic material shows a change in color and a reduction in dye production during color development.

Numerous proposals have already been put forward with a view to overcoming these disadvantages, the most promising solution lying in the use of magenta couplers having a different structure. Thus, it has been found that pyrazolotriazole magenta couplers do not show any unwanted absorption, are substantially unaffected by formaldehyde and show higly consistent dye production. On the other hand, the couplers in question have the disadvantage that the dispersions prepared with them, which are to be incorporated in the silver halide emulsions, are unstable. In addition, the absorption wavelengths of the dyes produced with these couplers are shorter than the desired value.

To overcome these difficulties, it is proposed in EP-A-145 342, in which many other literature references are cited, to disperse pyrazolotriazole magenta couplers having a certain structure in certain phenolic compounds (so-called oil formers) and to incorporate them in this form in the silver halide emulsion.

Although it is possible in this way to eliminate the difficulties mentioned above to a certain extent, the proposed solutions suffer from inadequate sensitivity, excessive fogging, inadequate formaldehyde stability and inadequate stability of the coupler dispersates prepared therefrom.

It has now been found that these difficulties may also be overcome by using special oil formers for pyrazolotriazole magenta couplers.

Accordingly, the present invention relates to a color photographic silver halide material which, in at least one silver halide emulsion layer, contains a magenta coupler corresponding to formula (I) or (II)

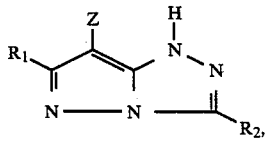

(I)

-continued

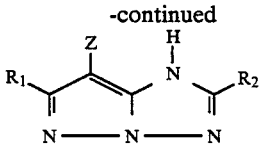

(II)

in which $R_1$ represents alkyl, aryl or a ballast group, $R_2$ represents a ballast group, alkyl or aryl, Z represents hydrogen or a group releasable on reaction with the developer oxidation product, and a compound corresponding to formula (III)

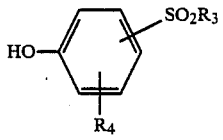

(III)

in which $R_3$ represents alkyl, alkoxy, aryl, optionally substituted amino or the residue of a heterocycle, $R_4$ represents $COR_5$, $NHR_6$, $S(O)_nR_7$, $R_5$ represents $OR_8$, $NHR_8$, alkyl, aryl or a heterocycle, $R_6$ represents $SO_2R_8$, $COR_8$ or $CONHR_8$, $R_7$ represents alkyl, aryl or $NHR_8$, $R_8$ represents alkyl or aryl and n=0, 1 or 2, with the exception of compounds in which $R_3$ represents a carboxymethoxyphenyl, carboxymethoxy, alkoxycarbonylmethoxy or alkoxycarbonylmethoxyphenyl radical substituted at the methylene group.

The alkyl radicals $R_1$ and $R_2$ contain in particular 1 to 16 carbon atoms, for example methyl, ethyl, butyl, dodecyl, isopropyl, tert.-butyl, isoamyl, and may be substituted by halogen atoms, $C_1$–$C_4$ alkylsulfonyl groups or phenoxy groups, for example $CF_3$, $C_3F_7$, $CH_3$—$SO_2$—$CH_2$—$CH_2$—$CH_2$.

The aryl radicals $R_1$ and $R_2$ are, in particular, phenyl or naphthyl radicals optionally substituted by $C_1$–$C_4$ alkyl, halogen, $C_1$–$C_4$ alkoxy, $C_1$–$C_4$ alkylcarbonylamino, $C_1$–$C_4$ alkylsulfonylamino, $C_1$–$C_4$ alkylsulfonyl, $C_1$–$C_4$ alkoxycarbonyl.

Either $R_1$ or $R_2$ is preferably a ballast group.

The releasable group Z is preferably halogen, for example chlorine, bromine, iodine or fluorine, an aryloxy group, for example phenoxy, p-methoxyphenoxy, p-butanesulfonamidophenoxy or p-tert.-butylcarbonamidophenoxy, an arylthio group, for example phenylthio, or a heterocyclic thio group, for example 1-ethyltetrazole-5-thiolyl. Z is preferably a halogen atom, more especially chlorine.

Ballast groups are groups which enable the compounds according to the invention to be incorporated in non-diffusing form in the hydrophilic colloids normally used for photographic materials. Preferred ballast groups are organic radicals which generally contain linear or branched aliphatic groups and, optionally, also isocyclic or heterocyclic aromatic groups generally containing 8 to 20 carbon atoms.

These radicals are attached to the remaining part of the molecule either directly or indirectly, for example through one of the following groups: —NHCO—, —$NHSO_2$—, —NR—, where R is hydrogen or alkyl, —O— or —S—. In addition, the radical which imparts resistance to diffusion may also contain water-solubilizing groups, such as for example sulfo groups or carboxyl groups, which may even be present in anionic form. Since the diffusion properties depend upon the size of the molecule of the overall compound used, it is sufficient in certain cases, for example if the overall molecule used is large enough, to use even relatively short-chain groups as ballast groups.

The pyrazolotriazole coupler preferably corresponds to formula (IV)

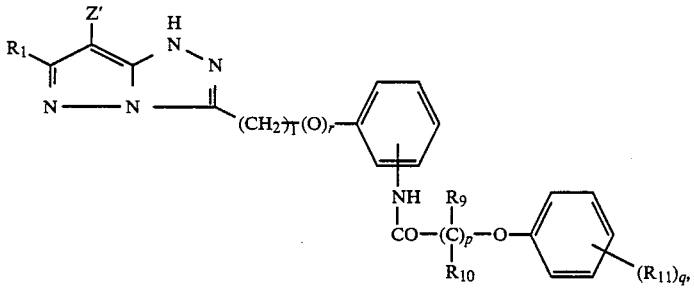

(IV)

in which

Z' is a group releasable by reaction with the developer oxidation product, $R_9$ and $R_{10}$ represent hydrogen or alkyl, $R_{11}$ represents alkyl, halogen or hydroxy, l, p and q have a value of 0 to 4 and r has a value of 0 or 1.

Preferably, l has a value of 0 to 3, p a value of 1 to 3 and q a value of 1 or 2.

Alkyl $R_3$, $R_5$, $R_7$, $R_8$, $R_9$, $R_{10}$ and $R_{11}$ is, in particular, $C_1$–$C_6$ alkyl; alkoxy $R_3$ is, in particular, $C_1$–$C_4$ alkoxy; aryl $R_3$, $R_5$, $R_7$ and $R_8$ is, in particular, phenyl and phenyl substituted by $C_1$–$C_4$ alkyl, $C_1$–$C_4$ alkoxy or halogen.

Optionally substituted amino $R_3$ is, in particular, amino, $C_1$–$C_{16}$ alkylamino, di-$C_1$–$C_{12}$-alkylamino, —NHCO—$R_8$, an NHCO heterocycle, —N-H—CO—$NHR_8$ and $NHSO_2$—$R_8$, where $R_8$ is as defined above and heterocycle is as defined below.

Suitable heterocyclic groups are, in particular, pyridyl and morpholinyl.

Typical examples of pyrazolotriazole magenta couplers according to the invention are shown in the following:

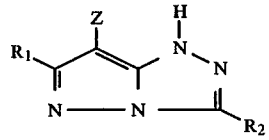
(I)
| Coupler | $R_1$ | Z | $R_2$ |
|---|---|---|---|
| C-1 | $CH_3$— | Cl— | 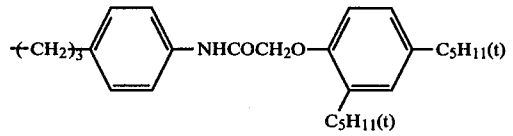 |
| C-2 | $CH_3$— | Cl— | 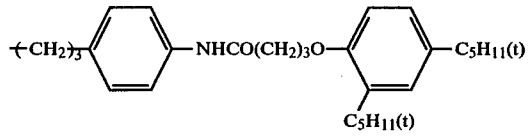 |
| C-3 | $CH_3$— | Cl— | 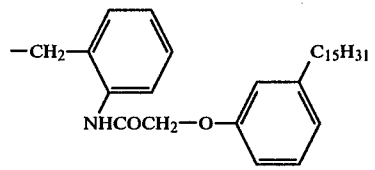 |
| C-4 | $CH_3$— | Cl— | 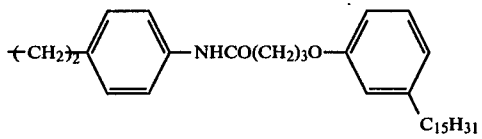 |
| C-5 | $CH_3$— | Cl— | 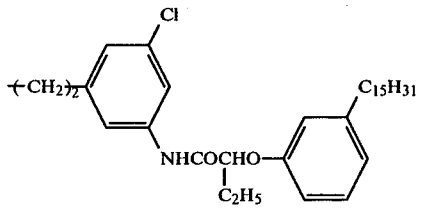 |

-continued
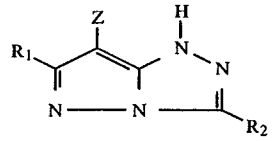
(I)
| Coupler | $R_1$ | Z | $R_2$ |
|---|---|---|---|
| C-6 | 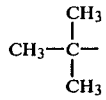 | Cl— | 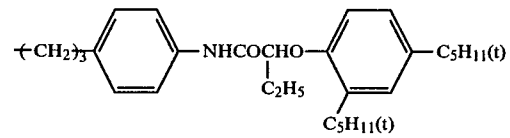 |
| C-7 | $CH_3$— | Cl— | 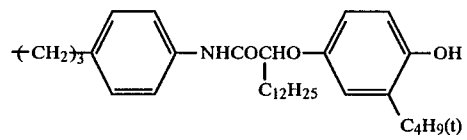 |
| C-8 | 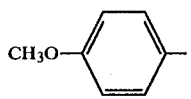 | Cl— | 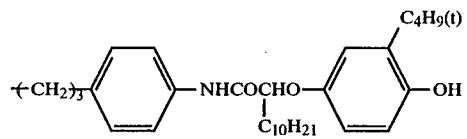 |
| C-9 | $CH_3$— | 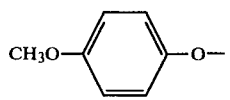 | 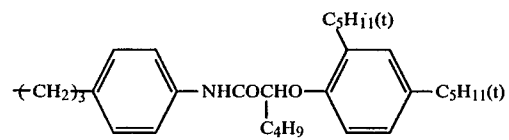 |
| C-10 | $CH_3$— | Cl— | 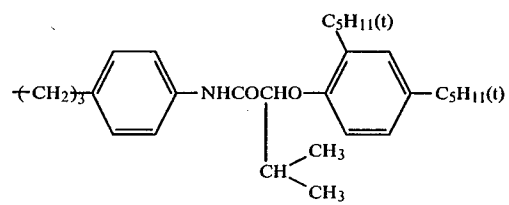 |

-continued
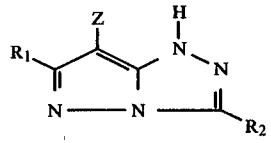
(I)
| Coupler | $R_1$ | Z | $R_2$ |
|---|---|---|---|
| C-11 | 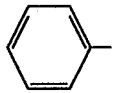 | Cl— | 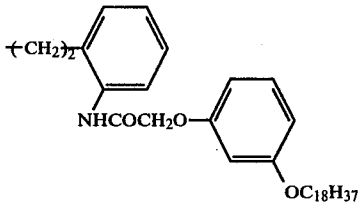 |
| C-12 | 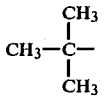 | Cl— | 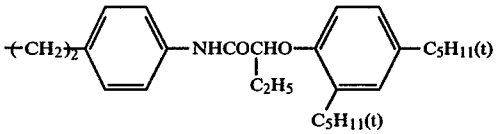 |
| C-13 | $CH_3$— | Cl— | 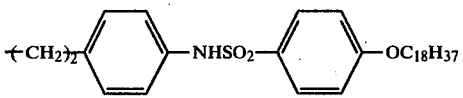 |
| C-14 | $CH_3$— | Cl— | 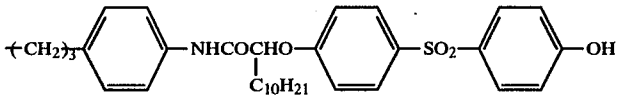 |
| C-15 | $CH_3$— | H— | 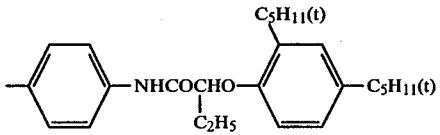 |
| C-16 | 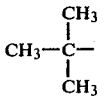 | H— | —$C_{18}H_{37}$ |

-continued
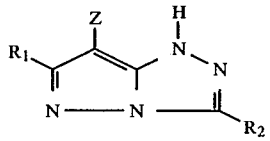
(I)
| Coupler | $R_1$ | Z | $R_2$ |
|---|---|---|---|
| C-17 | $CH_3$— | Cl— | 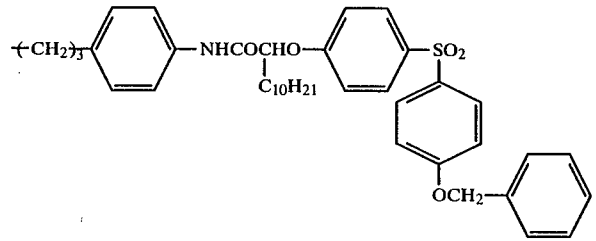 |
| C-18 | $CH_3$— | Cl— | 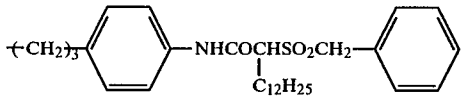 |
| C-19 | 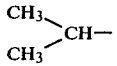 | 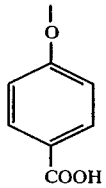 | 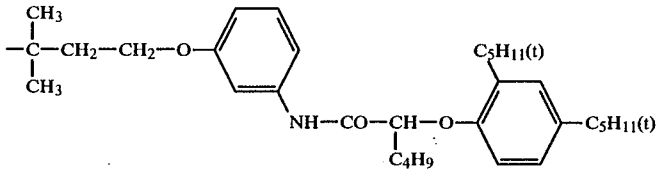 |
| C-20 | $CH_3$ | Cl | 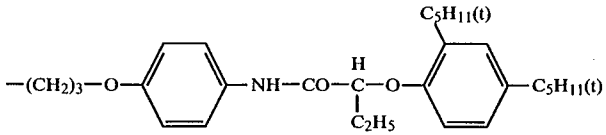 |
| C-21 | 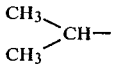 | 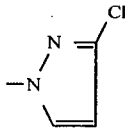 | 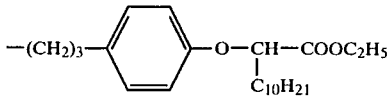 |

-continued
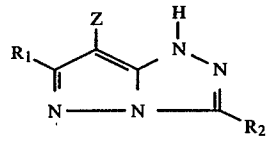
(I)
| Coupler | $R_1$ | Z | $R_2$ |
|---|---|---|---|
| C-22 | 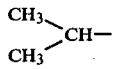 | —Cl | 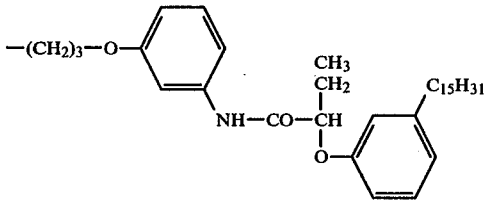 |
| C-23 | $CH_3$ | 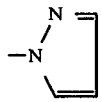 | 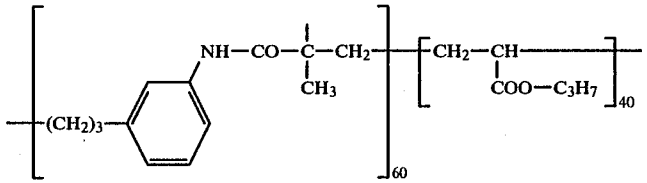 |
| C-24 | $CH_3$ | 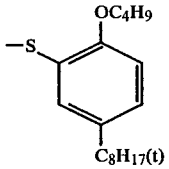 | 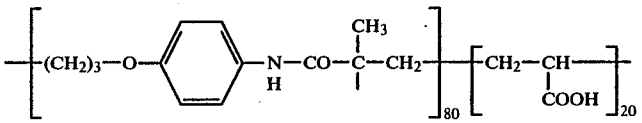 |
| C-25 | 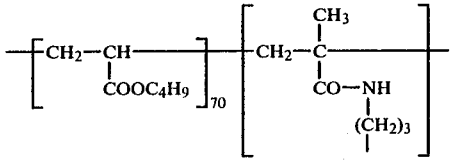 | Cl | 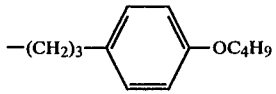 |

-continued
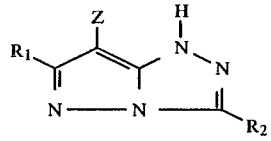
(I)
| Coupler | $R_1$ | Z | $R_2$ |
|---|---|---|---|
| C-26 | 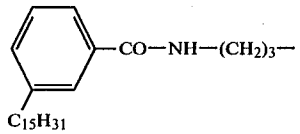 | 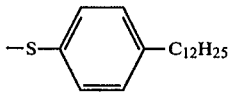 | $-C_4H_9-(n)$ |
| C-27 | 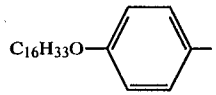 | 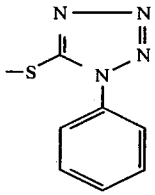 | $-C_3H_7(n)$ |
| C-28 | 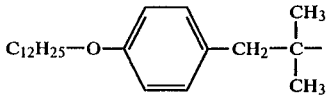 | 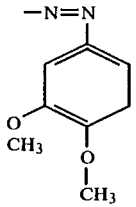 | $-C_3H_7(n)$ |

(II)
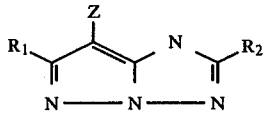
| Coupler | $R_1$ | Z | $R_2$ |
|---|---|---|---|
| C-29 | $CH_3$ | Cl | 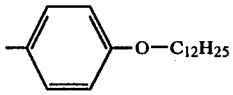 |
| C-30 | 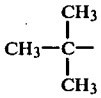 | Cl | 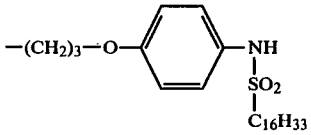 |
| C-31 | 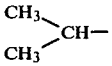 | 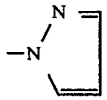 | 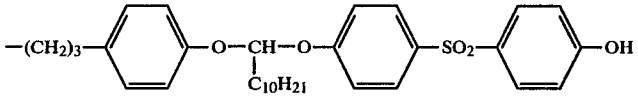 |
| C-32 | 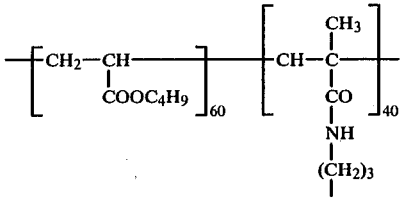 | Br | $-C_4H_9(n)$ |
| C-33 | 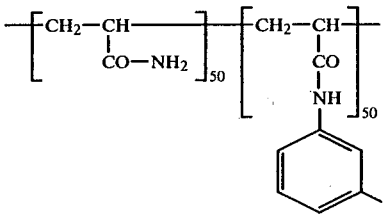 | 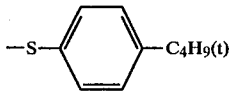 | $C_3H_7$ (i) |

-continued
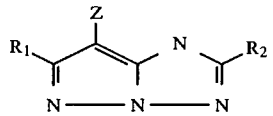
(II)
| Coupler | $R_1$ | Z | $R_2$ |
|---|---|---|---|
| C-34 | 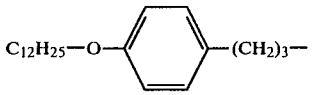 | 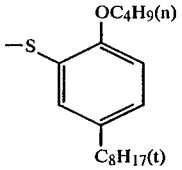 | 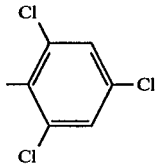 |
| C-35 | $CH_3$— | Cl | 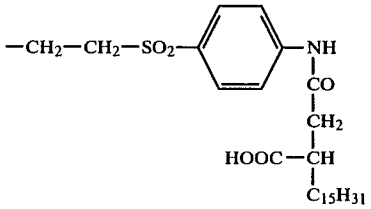 |
| C-36 | $CH_3$ | Cl | 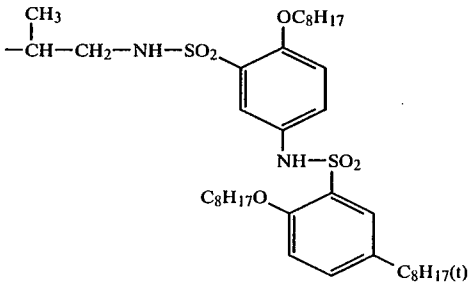 |
| C-37 | —$CH_3$ | —$NHCOCF_3$ | 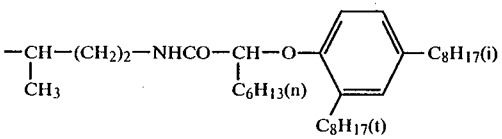 |

-continued
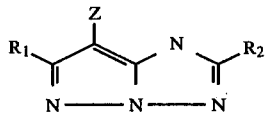
(II)
| Coupler | $R_1$ | Z | $R_2$ |
|---|---|---|---|
| C-38 | $-CH_3$ | $-O-CH(CH_3)_2$ | 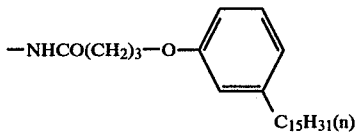 |
| C-39 | $-CH(CH_3)_2$ | $-Cl$ | 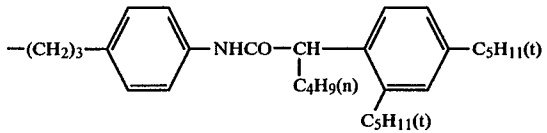 |
| C-40 | 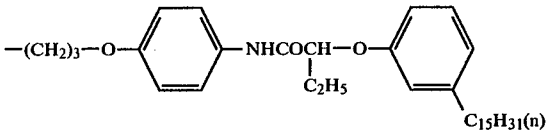 | 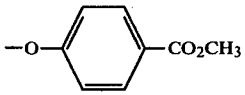 | $-CH(CH_2-CH_3)_2$ |
| C-41 | $-C(CH_3)_3$ | $-Cl$ | 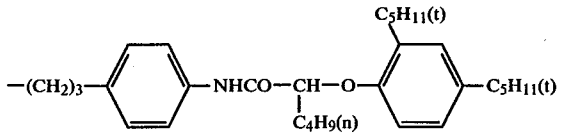 |
| C-42 | $-CBr(CH_3)_2$ | 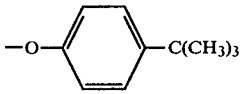 | 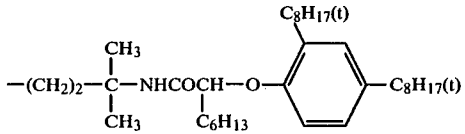 |

-continued
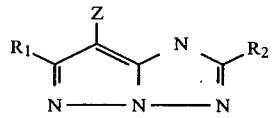
(II)
| Coupler | $R_1$ | Z | $R_2$ |
|---|---|---|---|
| C-43 | $-CH(C_2H_5)_2$ | $-NHCOC_3F_7(n)$ | 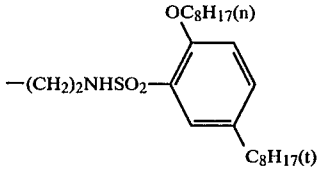 |
| C-44 | $-CH(CH_3)_2$ | $-Cl$ | 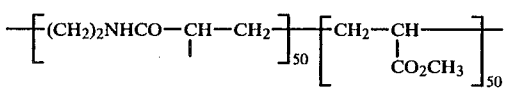 |
| C-45 | $-C(CH_3)_3$ | 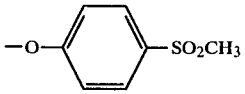 | 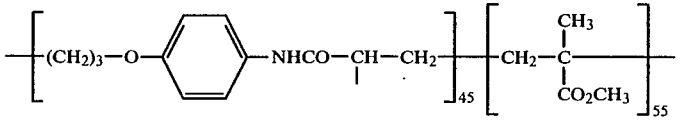 |
| C-46 | $-CH_3$ | $-Cl$ | 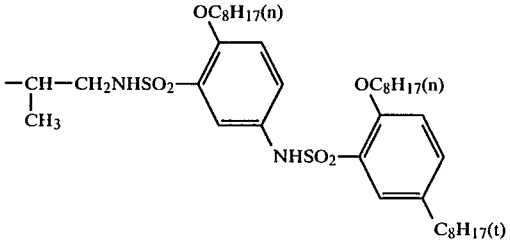 |

-continued
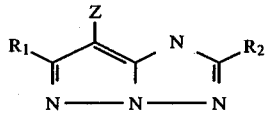
(II)
| Coupler | $R_1$ | Z | $R_2$ |
|---|---|---|---|
| C-47 | $-C_2H_5$ | $-Cl$ | 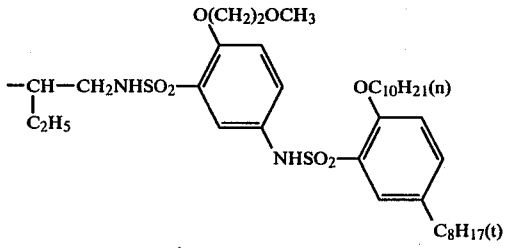 |
| C-48 | $-CH_3$ | 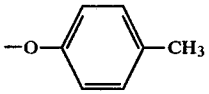 | 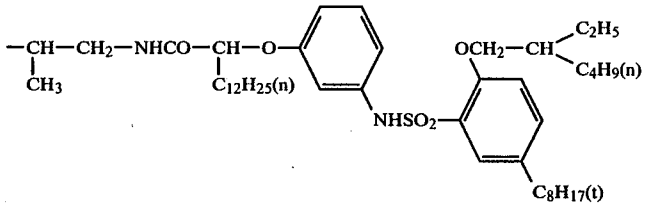 |
| C-49 | $-CH_3$ | $-Cl$ | 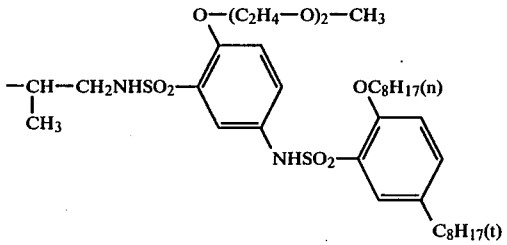 |
| C-50 | $-CH_3$ | $-Cl$ | 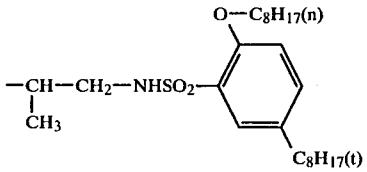 |

-continued
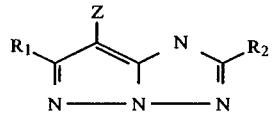
(II)
| Coupler | $R_1$ | Z | $R_2$ |
|---|---|---|---|
| C-51 | $-CH_3$ | 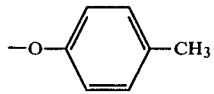 | 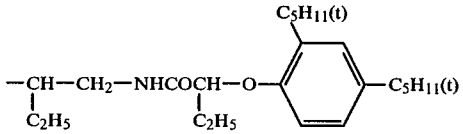 |
| C-52 | $-C(CH_3)_2-CH_2-OH$ | 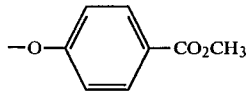 | 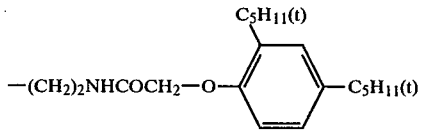 |
| C-53 | $-C(CH_3)_2COOC_2H_5$ | $-Cl$ | 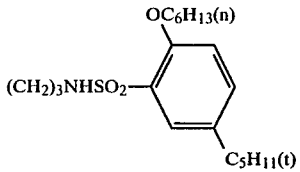 |
| C-54 | $-CH_3$ | $-Cl$ | 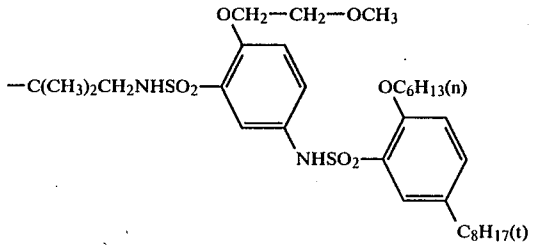 |

Typical examples of the phenolic compounds of formula III according to the invention are shown in the following:
(III)
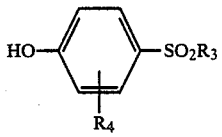
| | $R_3$ | $R_4$ |
|---|---|---|
| OF 1 | 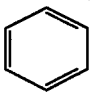 | —2-$COOC_5H_{11}$(i) |
| OF 2 | 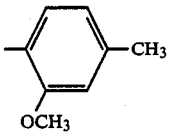  | —2-$COOC_2H_5$ |
| OF 3 | 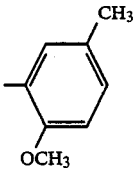  | —2-$COOC_2H_5$ |
| OF 4 | 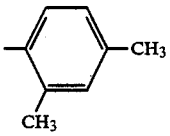  | —2-$COOC_5H_{11}$(i) |
| OF 5 | 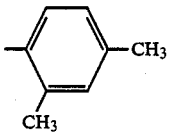  | —2-$COOC_5H_{11}$(i) |
| OF 6 | 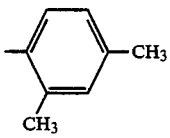  | —2-$COOC_8H_{17}$(n) |
| OF 7 | 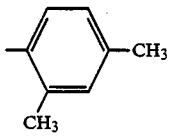  | —2-$COOC_{12}H_{25}$ |
| OF 8 | 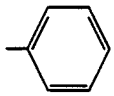 | —2-$COOC_2H_5$ |
| OF 9 | 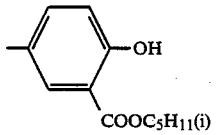  | —2-$COOC_5H_{11}$(i) |

-continued
(III)
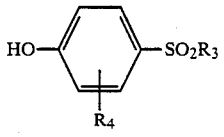
| | $R_3$ | $R_4$ |
|---|---|---|
| OF 10 | 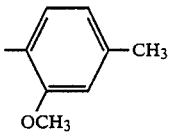 | —2-$COOC_5H_{11}$(i) |
| OF 11 | 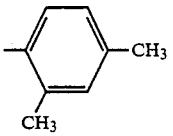 | —2-CONH—CH(—$C_{12}$—$H_{25}$(n))—$COOC_2H_5$ |
| OF 12 | 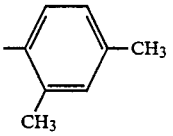 | —2-CONH—$CH_2$—$COOC_6H_{13}$(n) |
| OF 13 | —$C_2H_5$ | —2-$NHCOC_{12}H_{25}$(i) |
| OF 14 | —$C_2H_5$ | —2-$NHSO_2C_{16}H_{33}$(n) |
| OF 15 | —$C_2H_5$ | —2-$NHCOOC_{12}H_{25}$(n) |
| OF 16 | —$C_2H_5$ | 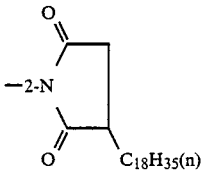 |
| OF 17 | —$C_2H_5$ | 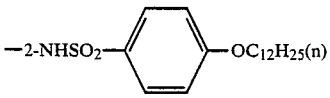 |
| OF 18 | —$C_2H_5$ | 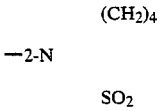 |
| OF 19 | —$C_2H_5$ | 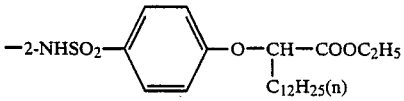 |
| OF 20 | —$C_2H_5$ | —2-$NHCO(CH_2)_2$—$COOC_{14}H_{29}$(n) |
| OF 21 | —$C_2H_5$ | —2-$NHCOCH_2$—CH($C_{18}H_{37}$(n))—COOH |
| OF 22 | —$C_2H_5$ | 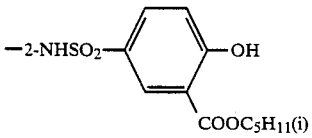 |
| OF 23 | —$C_2H_5$ | —2-$NHSO_2$—$(CH_2)_4Cl$ |
| OF 24 | —$C_2H_5$ | —2-NHCO—$(CH_2)_3$—$COOCH_3$ |

-continued (III)

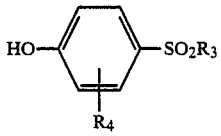

| | $R_3$ | $R_4$ |
|---|---|---|
| OF 25 | $-C_2H_5$ | 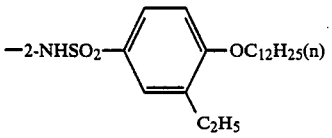 |
| OF 26 | $-C_2H_5$ | $-2\text{-}NHCO-\underset{\underset{Br}{\vert}}{CH}-C_{10}H_{21}(n)$ |
| OF 27 | $-C_2H_5$ | 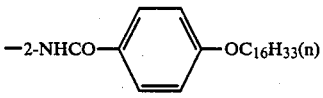 |
| OF 28 | $-C_2H_5$ | 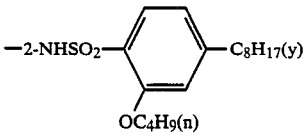 |
| OF 29 | $-C_2H_5$ | $-2\text{-}NHCO(CH_2)_2-OC_9H_{19}(i)$ |
| OF 30 | $-C_4H_9(n)$ | $-2\text{-}S-C_{12}H_{25}(n)$ |
| OF 31 | $-C_4H_9(n)$ | $-2\text{-}SO_2C_4H_9(n)$ |
| OF 32 | $-\underset{\underset{CH_3}{\vert}}{N}-C_{16}H_{33}(n)$ | $-2\text{-}COOC_2H_5$ |
| OF 33 | 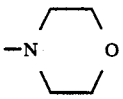 | $-2\text{-}COOC_{12}H_{25}-(n)$ |
| OF 34 | $-O-C_{12}H_{25}$ | $-2\text{-}NHCOC_4H_9$ |
| OF 35 | $-N(CH_3)_2$ | $-2\text{-}SO_2-C_{12}H_{25}(n)$ |
| OF 36 | $-C_2H_5$ | $-2\text{-}CO-C_6H_{13}(n)$ |
| OF 37 | $-N(C_2H_5)_2$ | 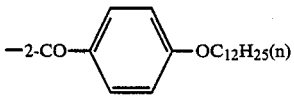 |
| OF 38 | 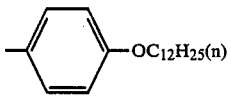 | 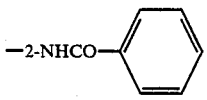 |
| OF 39 | $-\underset{\underset{CH_3}{\vert}}{N}-C_{12}H_{25}(n)$ | $-2\text{-}NHCONH-CH_2-CH(CH_3)_2$ |
| OF 40 | $-C_4H_9(n)$ | 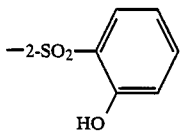 |

-continued (III)

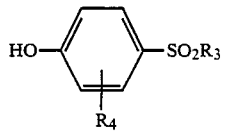

| | $R_3$ | $R_4$ |
|---|---|---|
| OF 41 | 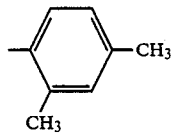 | 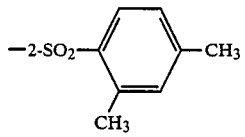 |
| OF 42 | 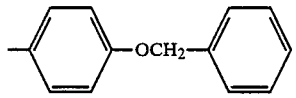 | 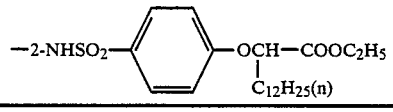 |

The production of the magenta couplers is known, for example, from EP-A-145 342. The phenolic compounds corresponding to formula (III) are prepared by known methods. One typical method is described in the Examples.

The silver halide may be in the form of predominantly compact crystals which may have, for example, regular cubic or octahedral forms or transitional forms. However, the silver halide may also be present in the form of platelet-like crystals of which the average diameter-to-thickness ratio is preferably less than 5:1, the diameter of a grain being defined as the diameter of a circle having an area corresponding to the projected area of the grain. The layers can also contain tabular silver halide crystals, of which the diameter-to-thickness ratio is greater than 5:1, for example 12:1 to 30:1.

The silver halide grains may also have a multilayer grain structure, in the most simple case with an inner and an outer grain zone (core/shell), the halide composition and/or other modifications, such as for example doping of the individual grain zones, being different. The average grain size of the emulsions is preferably between 0.2 μm and 2.0 μm and the grain size distribution may be both homodisperse and also heterodisperse. In addition to the silver halide, the emulsions may also contain organic silver salts, for example silver benztriazolate or silver behenate.

Two or more types of silver halide emulsions prepared separately may be used in admixture.

The photographic emulsions may be prepared from soluble silver salts and soluble halides by various methods (cf. for example P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The Focal Press, London (1966).

Precipitation of the silver halide preferably occurs in the presence of the binder, for example the gelatin, and may be carried out in an acidic, neutral or alkaline pH range, preferably in the additional presence of silver halide complexing agents, including for example ammonia, thioether, imidazole, ammonium thiocyanate or excess halide. The water-soluble silver salts and the halides may be combined either successively by the single-jet process or simultaneously by the double-jet process or by a combination of these two processes. Dosing at increasing inflow rates is preferred, although the "critical" feed rate, at which new seeds are still not quite formed, should not be exceeded. The pAg range may vary within wide limits during the precipitation process. The so-called pAg-controlled process is preferably used. In this process, a certain pAg value is kept constant or the pAg value passes through a certain pAg profile during the precipitation process. However, in addition to the preferred precipitation where halide is present in excess, so-called inverse precipitation is also possible where silver ions are present in excess. The silver halide crystals can grow not only through precipitation, but also by physical ripening (Ostwald ripening) in the presence of excess halide and/or silver halide complexing agent. The emulsion grains may even be predominantly grown by Ostwald ripening, in which case a fine-grain, so-called Lippmann emulsion is preferably mixed with a more difficulty soluble emulsion and dissolved in and allowed to crystallize thereon.

Salts or complexes of metals, such as Cd, Zn, Pb, Tl, Bi, Ir, Rh, Fe, may also be present during the precipitation and/or physical ripening of the silver halide grains.

In addition, precipitation may also take place in the presence of sensitizing dyes. Complexing agents and/or dyes may be inactivated at any time, for example by changing the pH value or by an oxidative treatment.

The silver halides may be, for example, silver bromide, silver bromide iodide with iodide contents of 0.1 to 40 mol-%, silver chloride, silver chloride bromide with bromide contents of 1 to 80 mol-% and silver bromide iodide chloride predominantly containing bromide.

Gelatin is preferably used as the binder, although it may be completely or partly replaced by other synthetic, semisynthetic or even naturally occurring polymers. Synthetic gelatin substitutes are, for example, polyvinyl alcohol, poly-N-vinylpyrrolidone, polyacrylamides, polyacrylic acid and derivatives thereof, more especially copolymers. Naturally occurring gelatin substitutes are, for example, other proteins, such as albumin or casein, cellulose, sugars, starch or alginates. Semisynthetic gelatin substitutes are, generally, modified natural products. Cellulose derivatives, such as hydroxyalkyl cellulose, carboxymethyl cellulose and phthalyl cellulose, and also gelatin derivatives which have been obtained by reaction with alkylating or acylating agents or by grafting on of polymerizable monomers are examples of semisynthetic gelatin substitutes.

The binders should contain an adequate number of functional groups so that sufficiently resistive layers can be produced by reaction with suitable hardeners. Such functional groups are, in particular, amino groups, but also carboxyl groups, hydroxyl groups and active methylene groups.

The gelatin preferably used may be obtained by acidic or alkaline digestion. The production of such gelatins is described, for example, in "The Science and Technology of Gelatine", A. G. Ward and A. Courts, Academic Press 1977, pages 295 et seq. The particular gelatin used should have a minimal content of photographically active impurities (inert gelatin). Gelatins of high viscosity and low swelling are particularly advantageous. The gelatin may be completely or partly oxidized.

After or even before crystal formation, the soluble salts are removed from the emulsion, for example by noodling and washing, by flocculation and washing, by ultrafiltration or by ion exchangers.

The photographic emulsions may contain compounds to prevent fogging or to stabilize the photographic function during production, storage or photographic processing. Particularly suitable compounds of the type in question are azaindenes, preferably tetra- and pentaazaindenes, more especially those substituted by hydroxyl or amino groups. Compounds such as these are described, for example by Birr, Z. Wiss. Phot. 47 (1952), pages 2 to 58. Other suitable antifogging agents are salts of metals, such as mercury or cadmium, aromatic sulfonic or sulfinic acids, such as benzene sulfinic acid, or nitrogen-containing heterocycles, such as nitrobenzimidazole, nitroindazole, (substituted) benztriazoles or benzthiazolinium salts. Particularly suitable antifogging agents are heterocycles containing mercapto groups, for example mercaptobenzthiazoles, mercaptobenzimidazoles, mercaptotetrazoles, mercaptothiazdiazoles, mercaptopyrimidines; these mercaptoazoles may also contain a water-solubilizing group, for example a carboxyl group or sulfo group. Other suitable compounds are published in Research Disclosure no. 17643 (1978), Chapter VI.

The stabilizers may be added to the silver halide emulsions before, during or after their ripening. The compounds may of course also be added to other photographic layers associated with a silver halide layer.

Mixtures of two or more of the compounds mentioned may also be used.

The silver halide emulsions are normally chemically ripened, for example by the action of gold compounds or compounds of divalent sulfur.

The photographic emulsion layers or other hydrophilic colloid layers of the photosensitive material produced in accordance with the invention may contain surface-active agents for various purposes, such as coating aids, for preventing electrical charging, for improving their anti-blocking properties, for emulsifying the dispersion, for preventing adhesion and for improving the photographic characteristics (for example development acceleration, high contrast, sensitization, etc.).

The photographic emulsions may be spectrally sensitized using methine dyes or other dyes. Particularly suitable dyes are cyanine dyes, merocyanine dyes and complex mercocyanine dyes.

There is no need to use sensitizers where the natural sensitivity of the silver halide for a certain spectral region, for example the blue sensitivity of silver bromide, is sufficient.

Color photographic materials normally contain at least one red-sensitive emulsion layer, one green-sensitive emulsion layer and one blue-sensitive emulsion layer. Non-diffusing monomeric or polymeric color couplers are associated with these emulsion layers and may be situated either in the same layer or in an adjacent layer. Normally, cyan couplers are associated with the red-sensitive layers, magenta couplers with the green-sensitive layers and yellow couplers with the blue-sensitive layers. According to the invention, magenta couplers of formula (I) or (II) may be used on their own or in admixture with other magenta couplers described in the following.

Color couplers for producing the cyan component dye image are generally couplers of the phenol or α-naphthol type, of which suitable examples can be found in the literature.

Color couplers for producing the yellow component dye image are generally couplers containing an open-chain keto-methylene group, more especially couplers of the α-acylacetamide type; suitable couplers for this purpose are α-benzoylacetanilide couplers and α-pivaloylacetanilide couplers, which are also known from the literature.

Color couplers for producing the magenta component dye image are generally couplers of the 5-pyrazolone type, the indazolone type or the pyrazoloazole type. Suitable examples of such couplers can be found in large numbers in the literature.

The color couplers are 4-equivalent couplers and also 2-equivalent couplers. 2-Equivalent couplers are derived from 4-equivalent couplers in that, in the coupling position, they contain a substituent which is released during the coupling reaction. 2-Equivalent couplers include those which are colorless . . . or accelerators. Examples of such 2-equivalent couplers are the known DIR couplers and also DAR and FAR couplers.

Since, in the case of DIR, DAR and FAR couplers, it is mainly the effectiveness of the group released during the coupling reaction which is important rather than the dye-forming properties of these couplers, DIR, DAR and FAR couplers which produce substantially colorless products in the coupling reaction are also suitable (DE-A-15 47 640).

The releasable group may also be a ballast group, so that the reaction with color developer oxidation products gives coupling products which are diffusible or at least show slight or limited mobility (US-A-4,420,556).

High molecular weight color couplers are described, for example, in DE-C-12 97 417, DE-A-24 07 569, DE-A-31 48 125, DE-A-32 17 200, DE-A-33 20 079, DE-A-33 24 932, DE-A-33 31 743, DE-A-33 40 376, EP-A-27 284, US-A-4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, dispersion or emulsion of the compound in question and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and in DE-A-26 09 742.

Hydrophobic compounds may also be introduced into the casting solution using high-boiling solvents, so-called oil formers. Corresponding methods are described, for example, in US-A-2,322,027, US-A-2,801,170, US-A-2,801,171 and EP-A-0 043 037.

Instead of using high-boiling solvents, it is also possible to use oligomers or polymers, so-called polymeric oil formers.

The compounds may be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, US-A-4,291,113.

However, it is important to bear in mind in this regard that couplers of formula (I) or (II) according to the invention are introduced into a casting solution using compounds corresponding to formula (III) and are introduced in this form into an emulsion layer.

Anionic water-soluble compounds (for example dyes) may also be incorporated in non-diffusing form using cationic polymers, so-called mordant polymers.

Suitable oil formers for other couplers and other compounds are, for example, phthalic acid alkyl esters, phosphoric acid esters, citric acid esters, benzoic acid esters, alkylamides, fatty acid esters and trimesic acid esters.

Color photographic material typically comprises at least one red-sensitive emulsion layer, at least one green-sensitive emulsion layer and at least one blue-sensitive emulsion layer on supports. The sequence of these layers may be varied as required. Couplers which form cyan, magenta and yellow dyes are normally incorporated in the red-, green- and blue-sensitive emulsion layers. However, different combinations may also be used.

Each of the photosensitive layers may consist of a single layer or may even comprise two or more partial silver halide emulsion layers (DE-C-11 21 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive and red-sensitive layers is suitably low, it is possible to omit the yellow filter layer and to select other layer arrangements in which the blue-sensitive layer, then the red-sensitive layer and, finally, the green-sensitive layers follow one another on the support.

The non-photosensitive intermediate layers generally arranged between layers of different spectral sensitivity may contain agents to prevent unwanted diffusion of developer oxidation products from one photosensitive layer into another photosensitive layer with different spectral sensitization.

Where several partial layers of the same spectral sensitivity are present, they may differ from one another in their composition, particularly in regard to the type and quantity of silver halide grains. In general, the partial layer of relatively high sensitivity will be arranged further away from the support than the partial layer of relatively low sensitivity. Partial layers of the same spectral sensitivity may be arranged adjacent one another or may be separated by other layers, for example by layers of different spectral sensitivity. For example, all high-sensitivity layers and all low-sensitivity layers may be respectively combined to form a single layer set (DE-A 19 58 709, DE-A 25 30 645, DE-A 26 22 922).

The photographic material may also contain UV-absorbing compounds, white toners, spacers, filter dyes, formalin binding agents and the like.

UV-absorbing compounds are intended on the one hand to protect the image dyes against bleaching by UV-rich daylight and, on the other hand, to act as filter dyes in absorbing the UV light in daylight on exposure and, hence, to improve the color reproduction of a film. Compounds of different structure are normally used for these two functions. Examples are aryl-substituted benzotriazole compounds (U.S.-A-No. 3,533,794), 4-thiazolidone compounds (U.S.-A-Nos. 3,314,794 and 3,352,681), benzophenone compounds (JP-A No. 2784/71), cinnamic acid ester compounds (U.S.-A-Nos. 3,705,805 and 3,707,375), butadiene compounds (U.S.-A-No. 4,045,229) or benzoxazole compounds (U.S.-A-No. 3,700,455).

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styrene dyes, merocyanine dyes, cyanine dyes and azo dyes. Of these dyes, oxonol dyes, hemioxonol dyes and mercocyanine dyes are used with particular advantage.

Suitable white toners are described, for example, in Research Disclosure 17643, December 1978, Chapter V, pages 22 et seq.

Certain binder layers, particularly the layer situated furthest from the support, and also occasionally intermediate layers, particularly where they represent the layer furthest away from the support during production, may contain photographically inert particles of inorganic or organic nature, for example as matting agents or as spacers (DE-A 33 31 542, DE-A 34 24 893, Research Disclosure 17643, December 1978, Chapter XVI, pages 22 et seq.).

The average particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The binders of the material according to the invention, particularly where gelatin is used as binder, are hardened with suitable hardeners, for example with hardeners of the epoxide type, the ethyleneimine type, the acryloyl type or the vinylsulfone type. Hardeners of the diazine, triazine or 1,2-dihydroquinoline series are also suitable.

The binders of the material according to the invention are preferably hardened with instant hardeners.

Instant hardeners are understood to be compounds which crosslink suitable binders in such a way that, immediately after casting and, at the latest, 24 hours after casting and preferably 8 hours after casting at the latest, hardening has progressed to such an extent that there is no further change in the sensitometric data or in the swelling of the layers through the crosslinking reaction. By swelling is meant the difference between wet layer thickness and dry layer thickness in the aqueous processing of the film (Photogr. Sci. Eng. 8 (1964), 275; Photogr. Sci. Eng. (1972), 449).

These hardeners which react very quickly with gelatin are, for example, carbamoyl pyridinium salts which are capable of reacting with free carboxyl groups of the gelatin so that the free carboxyl groups react with free amino groups of the gelatin with formation of peptide bonds and crosslinking of the gelatin.

Suitable instant hardeners are, for example, compounds corresponding to the following general formulae:

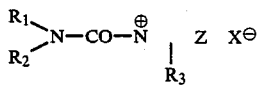

(a)

in which $R_1$ represents alkyl, aryl or aralkyl, $R_2$ has the same meaning as $R_1$ or represents alkylene, arylene, aralkylene or alkaralkylene, the second bond being attached to a group of the formula

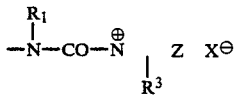

or $R_1$ and $R_2$ together represent the atoms required to complete an optionally substituted heterocyclic ring, for example a piperidine, piperazine or morpholine ring, which may be substituted, for example, by $C_1$–$C_3$ alkyl or halogen, $R_3$ represents hydrogen, alkyl, aryl, alkocy, $—NR_4—COR_5$, $—(CH_2)_m—NR_8R_9$, $—(CH_2)_n—CONR_{13}R_{14}$ or

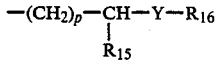

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ is hydrogen, $C_1$–$C_4$ alkyl or $NR_6R_7$, $R_8$ is $—COR_{10}$ $R_{10}$ is $NR_{11}R_{12}$ $R_{11}$ is $C_1$–$C_4$ alkyl or aryl, particularly phenyl, $R_{12}$ is hydrogen, $C_1$–$C_4$ alkyl or aryl, particularly phenyl, $R_{13}$ is hydrogen, $C_1$–$C_4$ alkyl or aryl, particularly phenyl, $R_{16}$ is hydrogen, $C_1$–$C_4$ alkyl, $COR_{18}$ or $CONHR_{19}$, m has a value of 1 to 3, n has a value of 0 to 3, p has a value of 2 to 3 and Y is 0 or $NR_{17}$ or $R_{13}$ and $R_{14}$ together represent the atoms required to complete an optionally substituted heterocyclic ring, for example a piperidine, piperazine or morpholine ring, $C_1$–$C_3$ alkyl or halogen, Z represents the carbon atoms required to complete a 5- or 6- membered aromatic heterocyclic ring, optionally with a fused benzene ring, and $X^\theta$ is an anion which is redundant where an anionic group is already attached to the remainder of the molecule;

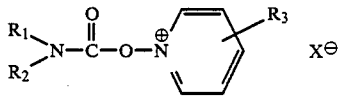

(b)

in which $R_1$, $R_2$, $R_3$ and $X^\theta$ are as defined for formula (a).

The materials according to the invention, whether color negative or color reversal films, color negative or color reversal paper or direct positive materials, are processed in the usual way by recommended processes.

SYNTHESIS OF 5

186 g salicylic acid isoamyl ester-4-sulfochloride were heated to 30° C. in 650 ml m-xylene, followed by the addition in portions of 97 g iron(III) chloride. The temperature was kept between 30° and 40° C. After stirring for 30 minutes, the mixture was stirred into 5 l ice water and, after the addition of 1 l ethylacetate, the organic phase was separated. After drying over $Na_2SO_4$, the solvent was distilled off in a rotary evaporator.

Yield: 170 g=75% of the theoretical (oil).

SYNTHESIS OF 25

142 g 2-amino-4-ethylsulfonylphenol hydrochloride were dissolved in 1000 ml pyridine and 232 g 3-ethyl-4-dodecyloxybenzenesulfochloride added in portions to the resulting solution at a temperature of 25° to 30° C. After stirring for 30 minutes, the reaction mixture was introduced with vigorous stirring into a mixture of ice, water and hydrochloric acid. The product precipitated was filtered off under suction, washed with water and recrystallized from methanol.

Yield: 250 g=75.3% of the theoretical,

Mp.: 60°–62° C.

EXAMPLE 1

Quantities of 8 mmol magenta coupler (see Table 1) were dissolved in ethylacetate (EA) heated to around 50° C., after which oil formers (OF; see Table 1) and sulfosuccinic acid di-n-octylester (emulsifier) were added so that a ratio by weight of coupler to OF to EA to emulsifier of 1:1:3:0.1 was obtained. This was followed by emulsification in 7.5% by weight gelatin solution. Depending on the molecular weight, a ratio of coupler to gelatin of approximately 1:2 was obtained. The emulsate was stirred for 6 minutes at 1000 r.p.m., undergoing an increase in temperature to 50° C. and the EA being removed in a water jet vacuum (200–300 mbar).

The quality of the fresh coupler emulsates was evaluated as follows using a phase contrast or polarization microscope:

(a) Particle size

1: very fine (<0.5 μm)

2: fine (<1.0 μm)

3: fine with some larger particles

4: medium

5: coarse (b) Homogeneity

1: no crystals visible

2: some crystals visible

3: many crystals visible

4: heavily crystallized
The same evaluation was carried out after the emulsates had been intensively stirred for 3 h and 6 h at 50° C.
Comparison Couplers
Comp. 1
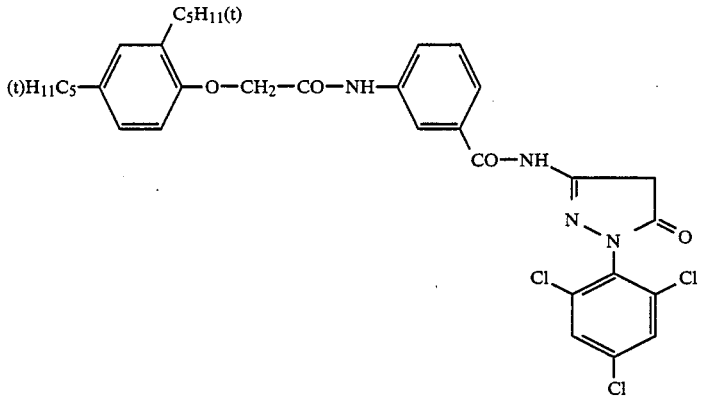
Comp. 2
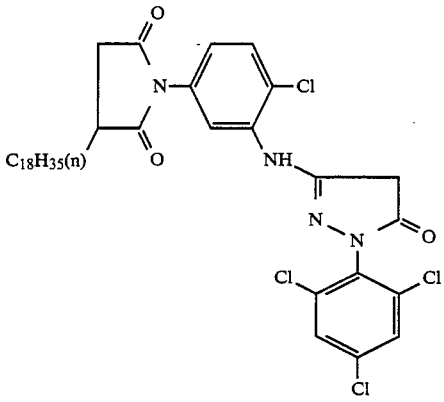
Comp. 3
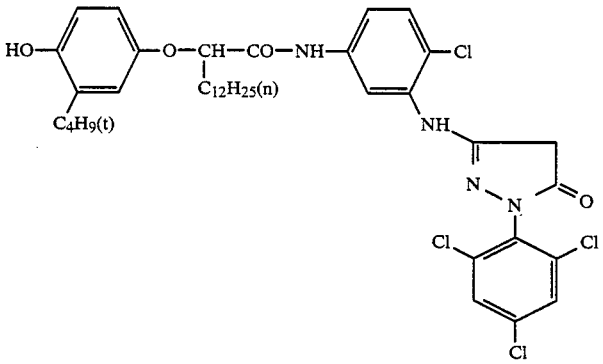
Comp. 3
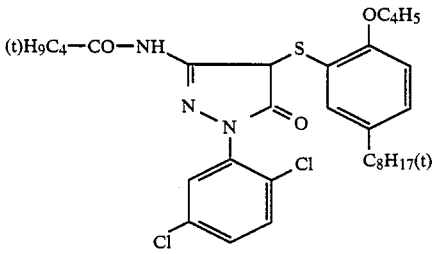

-continued

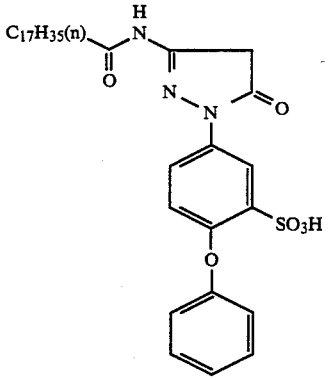

Comparison Oil Former

CO 1

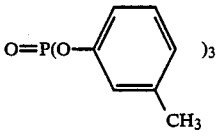

CO 2

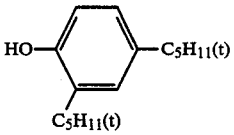

CO 3

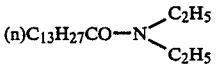

CO 4

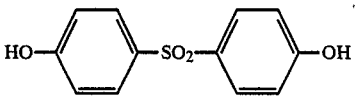

CO 5

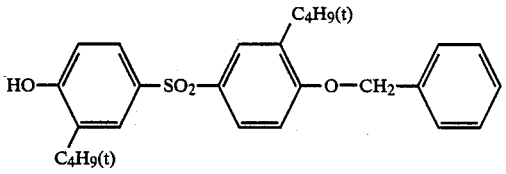

CO 6

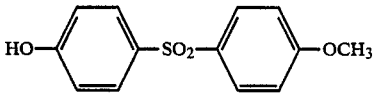

TABLE 1

| Coupler | Oil former | Quality of the coupler emulsates: fresh a | fresh b | 3 h/ 50° C. a | 3 h/ 50° C. b | 6 h/ 50° C. a | 6 h/ 50° C. b |
|---|---|---|---|---|---|---|---|
| Comp. 1 | CO 1 | 2 | 2 | 3 | 3 | 5 | 4 |
| Comp. 1 | OF 1 | 1 | 1 | 3 | 3 | 4 | 4 |
| Comp. 2 | CO 2 | 3 | 3 | 3 | 3 | 3 | 4 |
| Comp. 2 | OF 12 | 3 | 2 | 3 | 3 | 4 | 3 |
| Comp. 3 | CO 4 | 2 | 2 | 2 | 2 | 4 | 4 |
| Comp. 3 | OF 16 | 2 | 3 | 3 | 3 | 4 | 4 |
| Comp. 4 | CO 3 | 3 | 3 | 3 | 4 | 4 | 4 |
| Comp. 4 | OF 3 | 2 | 3 | 2 | 4 | 4 | 4 |
| Comp. 5 | CO 5 | 3 | 3 | 3 | 4 | 3 | 4 |
| Comp. 5 | OF 15 | 3 | 4 | 4 | 4 | 4 | 4 |
| C 1 | CO 6 | 3 | 3 | 3 | 4 | 4 | 4 |
| C 1 | CO 1 | 3 | 4 | 3 | 4 | 5 | 4 |
| C 1 | CO 3 | 3 | 3 | 3 | 3 | 4 | 3 |
| C 1 | CO 2 | 2 | 4 | 4 | 4 | 4 | 4 |

TABLE 1-continued

| | Coupler | Oil former | Quality of the coupler emulsates: fresh a | fresh b | 3 h/ 50° C. a | 3 h/ 50° C. b | 6 h/ 50° C. a | 6 h/ 50° C. b |
|---|---|---|---|---|---|---|---|---|
| Invention | C 1 | OF 1 | 1 | 2 | 1 | 2 | 2 | 2 |
| | C 9 | CO 2 | 3 | 3 | 3 | 4 | 4 | 4 |
| Invention | C 9 | OF 6 | 1 | 2 | 1 | 2 | 1 | 2 |
| Invention | C 9 | OF 11 | 1 | 1 | 1 | 1 | 2 | 1 |
| Invention | C 9 | OF 25 | 1 | 2 | 2 | 2 | 2 | 2 |
| | C 14 | CO 6 | 3 | 3 | 3 | 4 | 4 | 4 |
| Invention | C 14 | OF 6 | 1 | 1 | 1 | 1 | 1 | 2 |
| | C 17 | CO 1 | 4 | 1 | 4 | 3 | 4 | 4 |
| Invention | C 17 | OF 31 | 1 | 1 | 1 | 1 | 1 | 2 |

EXAMPLE 2

The emulsates prepared in accordance with Example 1 were mixed with a silver bromide iodide emulsion (0.7 mol-% iodide) in a ratio of 1 mol coupler to 5.2 mol $AgNO_3$, the resulting mixture applied to a layer support of cellulose acetate and then overcoated with a protective layer of a 3% by weight gelatin solution containing a carbamoyl pyridinium betaine (CAS Reg. no. 65411-60-1) as hardener. After drying and cutting, the samples thus prepared were exposed behind a step wedge and processed by the negative AP 70 process (38° C.).

| Bath | Min. |
|---|---|
| color developer (CD 70) | 3.25 |
| bleaching | 6.5 |
| rinsing | 3.0 |
| fixing | 6.5 |
| rinsing | 6.0 |

The following baths were used:

| Color developer | |
|---|---|
| 8000 ml | water |
| 17 g | hydroxyethanediphosphonic acid Na |
| 12 g | ethylenediaminetetraacetic acid (EDTA acid) |
| 47 g | 1-(N—ethyl-N—hydroxyethyl)-3-methyl-p-phenylene-diamine |
| 25 g | hydroxylammonium sulfate |
| 39 g | sodium sulfite |
| 15.5 g | sodium hydrogen carbonate |
| 335 g | potassium carbonate |
| 13.5 g | potassium bromide |
| | make up with water to 10 l; pH 10.0 |

| Bleaching bath | |
|---|---|
| 8000 ml | water |
| 1390 g | ammonium bromide |
| 865 g | EDTA $NH_4$-Fe |
| 163 g | EDTA acid |
| 100 g | ammonia |
| | make up with water to 10 l and adjust to pH 6.0 ± 0.1 with approx. 15 ml glacial acetic acid |

| Fixing bath | |
|---|---|
| 8000 ml | water |
| 1500 g | ammonia thiosulfate |
| 100 g | sodium sulfite |
| 20 g | sodium hexametaphosphate |
| | make up with water to 10 l, pH 7.5 |

The abbreviations used in Table 2 below have the following meanings:

S = sensitivity in DIN units
γ = slope of the characteristic curve in the linear portion
DY = dye yield in $D_{max}$/Ag applied
F = fog

TABLE 2

| Coupler | Oil former | S | γ | DY | F |
|---|---|---|---|---|---|
| Comp. 1 | CO 1 | ±0(standard) | 0.5 | 1.40 | 0.13 |

TABLE 2-continued

| Coupler | Oil former | S | γ | DY | F |
|---|---|---|---|---|---|
| Comp. 1 | OF 1 | −1.0 | 0.58 | 2.00 | 0.14 |
| C 1 | CO 3 | −3.0 | 0.30 | 1.43 | 0.12 |
| C 1 | OF 11 | +2.0 | 1.10 | 3.20 | 0.10 |
| C 20 | OF 6 | +1.8 | 1.04 | 3.05 | 0.11 |
| C 14 | CO 4 | −5.0 | 0.57 | 1.82 | 0.13 |
| C 14 | OF 11 | +3.1 | 1.05 | 3.40 | 1.12 |

It can be seen from Table 2 that the combination according to the invention is distinguished from the known couplers and oil formers by high sensitivity, steep gradation and high yield for comparable fresh fog values.

EXAMPLE 3

Before exposure and processing in accordance with Example 2, individual layers of the couplers and oil formers shown in Table 3 which had been prepared in accordance with Example 2 were exposed to a formalin concentration of 10 ppm for 0, 3, 7, 14 and 21 days at 70% relative air humidity.

After processing, the following color density values were obtained:

TABLE 3

| | | $D_{max}$ after exposure to $CH_2$-0 | | | | |
|---|---|---|---|---|---|---|
| Coupler | Oil former | 0 | 3 | 7 | 14 | 21 days |
| Comp. 1 | CO 1 | 2.2 | 2.0 | 1.6 | 1.10 | 0.8 |
| Comp. 1 | CO 4 | 2.4 | 2.4 | 2.0 | 1.4 | 0.9 |
| Comp. 1 | OF 11 | 2.3 | 2.0 | 1.7 | 1.3 | 0.8 |
| C 1 | CO 4 | 1.2 | 1.2 | 1.1 | 1.0 | 0.8 |
| C 1 | OF 11 | 2.9 | 2.9 | 2.85 | 2.80 | 2.70 |

EXAMPLE 4

A color photographic recording material for negative color development was prepared by applying the following layers in the order indicated to a transparent layer support of cellulose triacetate. The quantities are all based on 1 $m^2$. For the silver halide coating, the corresponding quantities of $AgNO_3$ are shown. All the silver halide emulsions were stabilized with 0.5 g 4-hydroxy-6-methyl-1,3,3a,7-tetraazaindene per 100 g $AgNO_3$.

Layer 1 (Anti-halo layer)
black colloidal silver sol containing
0.18 g Ag
0.30 g UV absorber UV-1
1.5 g gelatin
Layer 2 (Intermediate layer)
Silver bromide iodide emulsion (0.8 mol-% iodide) of 0.15 g $AgNO_3$ containing
0.15 g 2,5-dioctyl hydroquinone
0.11 g coupler CY 1
0.3 g gelatin
Layer 3 (1st red-sensitized layer)
red-sensitized silver bromide iodide emulsion (5 mol-% iodide) of 0.7 g $AgNO_3$ containing
0.1 g coupler CY 2
0.3 g coupler CY 3
0.01 g coupler CY 4
1.2 g gelatin
Layer 4 (2nd red-sensitized layer)
red-sensitized silver bromide iodide emulsion (10 mol-% iodide) of 1.2 g $AgNO_3$ containing
0.1 g coupler CY 2
0.05 g coupler CY 3

0.05 g Coupler CY 5
0.9 g gelatin
Layer 5 (3rd red-sensitized layer)
red-sensitized silver bromide iodide emulsion (10 mol-% iodide) of 2.0 g $AgNO_3$ containing
0.05 g coupler CY 3
0.15 g coupler CY 5
0.003 g coupler DIR 1
0.8 g gelatin
Layer 6 (Intermediate layer)
0.5 g gelatin
Layer 7 (1st green-sensitized layer)
green-sensitized silver bromide iodide emulsion (5 mol-% iodide) of 0.5 g $AgNO_3$ containing
0.3 g coupler comp. 1 in CO 1
0.4 g coupler MG 1
0.5 g coupler MG 2
0.5 g coupler DIR 2
1.2 g gelatin
Layer 8 (2nd green-sensitized layer)
green-sensitized silver bromide iodide emulsion (6 mol-% iodide) of 1.0 g $AgNO_3$ containing
0.25 g coupler comp. 1 in CO 1
0.01 g coupler MG 1
0.01 g coupler MG 2
0.01 g coupler DIR 2
1.7 g gelatin
Layer 9 (3rd green-sensitive layer)
green-sensitized silver bromide iodide emulsion (10 mol-% iodide) of 1.5 g $AgNO_3$ containing
0.015 g coupler MG 1
0.07 g coupler comp. 1 in CO 1
0.002 g coupler DAR 1
1.0 g gelatin
Layer 10 (Yellow filter layer)
yellow colloidal silver sol of 0.05 g Ag containing
0.03 g 3.5-di-tert.-octylhydroquinone and
0.6 g gelatin
Layer 11 (1st blue-sensitive layer)
silver bromide iodide emulsion (5 mol-% iodide) of 0.3 g $AgNO_3$ containing
0.7 g coupler Y 1
0.03 g coupler DIR 3
1.4 g gelatin
Layer 12 (2nd Blue-sensitive layer)
silver bromide iodide emulsion (5 mol-% iodide) of 0.3 g $AgNO_3$ containing
0.25 g coupler Y 1
0.6 g gelatin
Layer 13 (Micrate layer)
silver bromide iodide emulsion (2 mol-% iodide) of 0.4 g $AgNO_3$ containing
0.1 g gelatin
Layer 14 (3rd blue-sensitive layer)
silver bromide iodide emulsion (10 mol-% iodide) of 0.8 g $AgNO_3$ containing
0.2 g coupler Y 1
0.5 g gelatin
Layer 15 (1st protective layer)
0.14 g UV absorber UV-1
0.20 g UV absorber UV-2
0.4 g gelatin
Layer 16 (2nd protective layer)
0.95 g hardener CAS Reg. no. 65411-60-1
0.23 g gelatin The recording material thus prepared is called material A (comparison). A material B (invention) was prepared in the same way, differing from material A only in the fact that coupler C 2 in OF 11 was used in layers 7, 8 and 9 instead of comp. 1 in CO 1.

After exposure and processing as described in Example 2, the following sensitometric data were obtained. The values obtained when materials A and B were stored in a drying cabinet (35° C./85% relative humidity) for 1 week before exposure are shown in brackets.

| | Coupler | Oil former | S | $D_{max}$ | γ | F |
|---|---|---|---|---|---|---|
| A | comp. 1 | CO 1 | ±0 standard (+0.5) | 2.0 (2.10) | 0.8 (0.65) | 0.12 (0.18) |
| B | C 2 | OF 11 | +2.0 (2.0) | 2.88 (2.75) | 1.10 (1.10) | 0.11 (0.12) |

After exposure to 10 ppm formalin at 70% relative air humidity for 21 days before exposure and processing, $D_{max}$ of material A had fallen to 0.95 while $D_{max}$ of material B had only fallen to 2.70.

The following compounds were used:

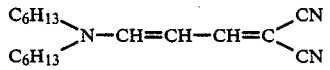

UV-1

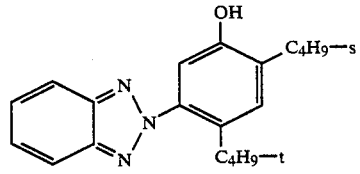

UV-2

-continued
CY 1
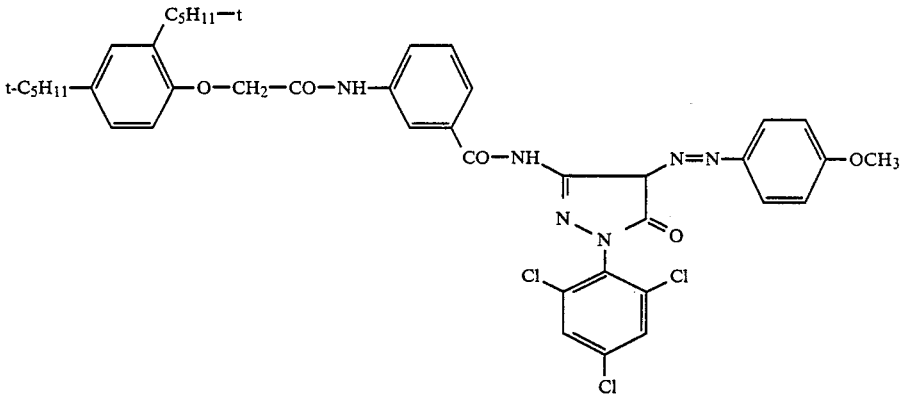
CY 2
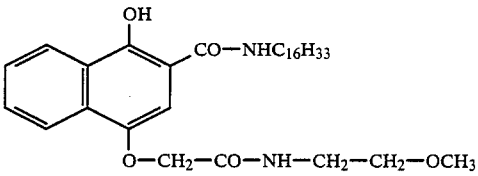
CY 3
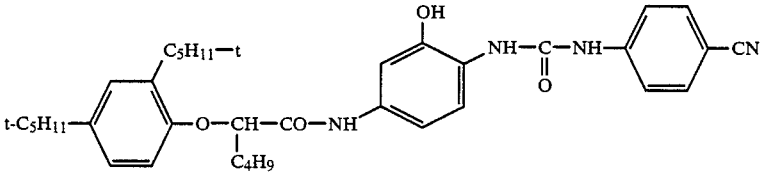
CY 4
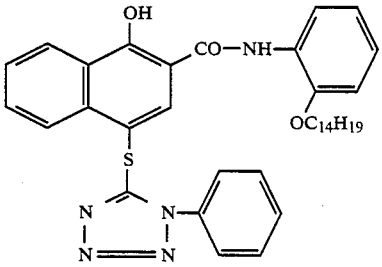
CY 5
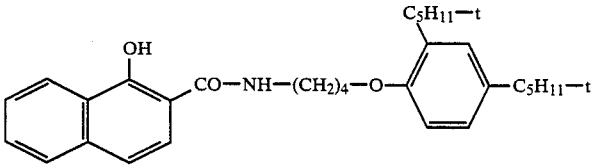
DIR 1
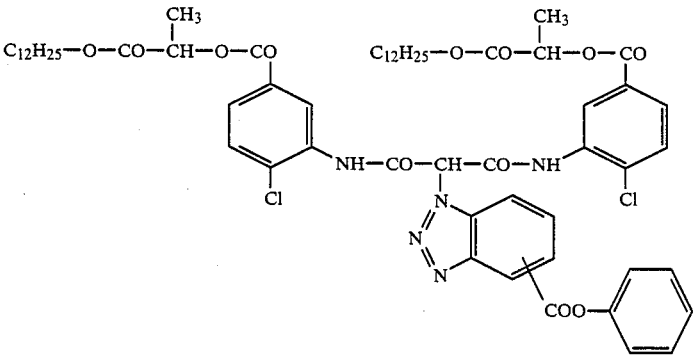

-continued
MG 1
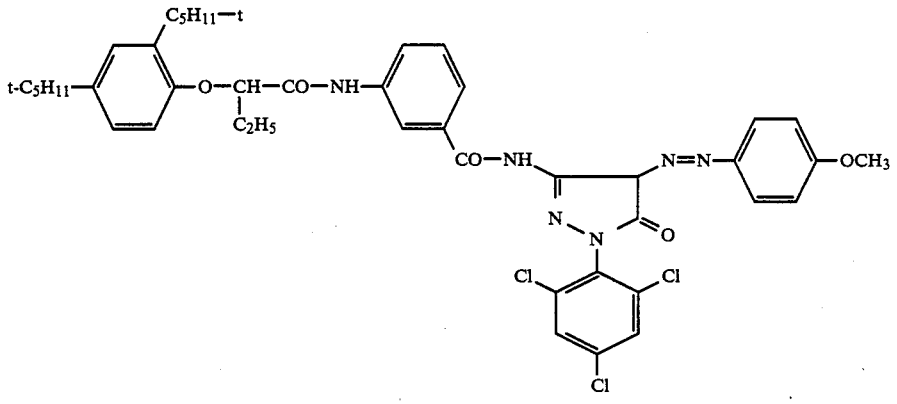
MG 2
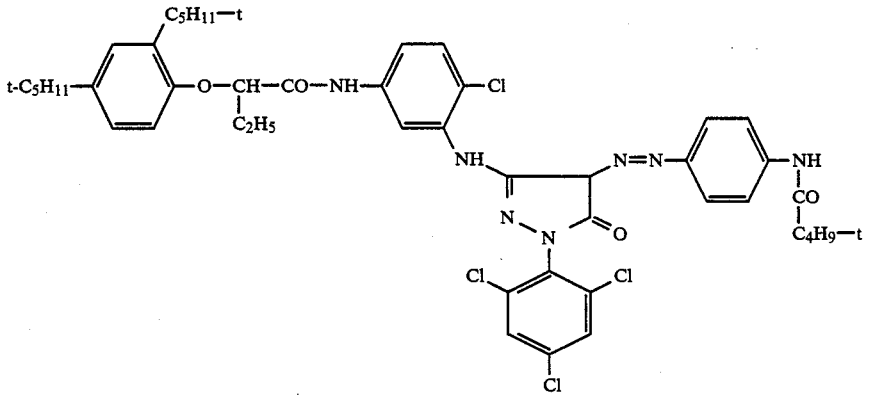
DIR 2
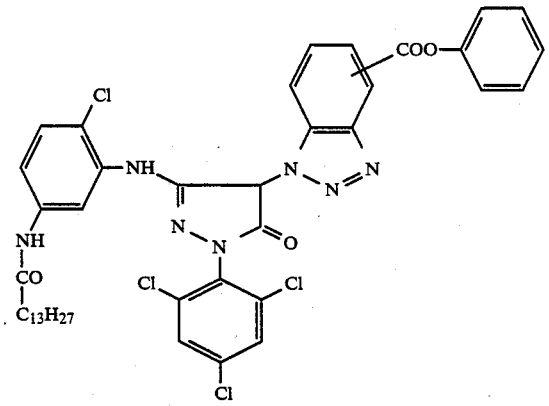
DAR 1
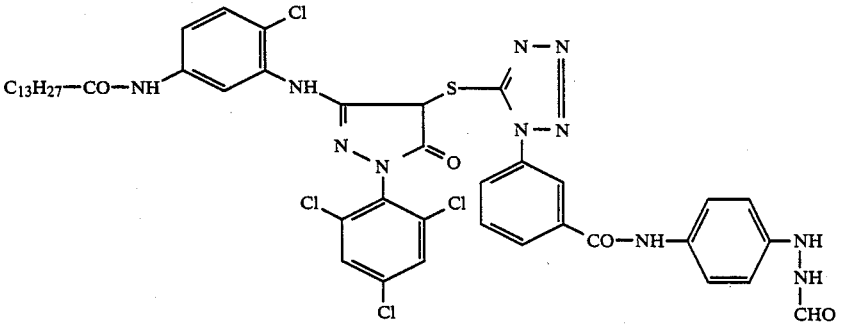

-continued

Y 1

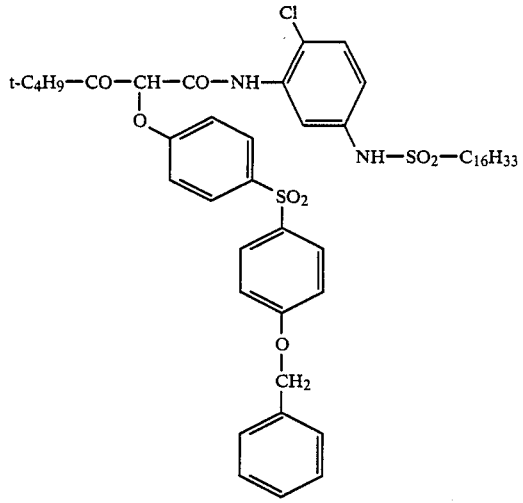

DIR 3

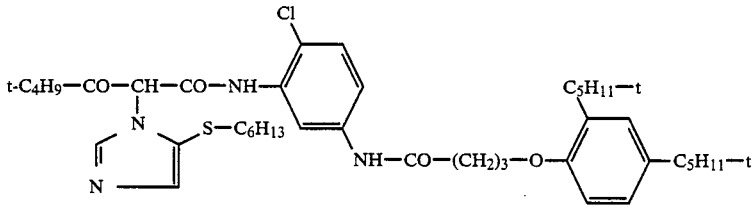

We claim:

1. A color photographic silver halide material which, in at least one silver halide emulsion layer, contains a magenta coupler corresponding to formula (I) or (II)

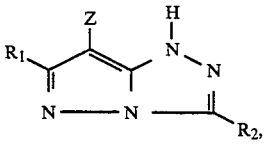

(I)

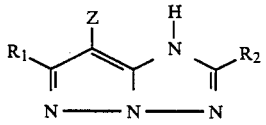

(II)

in which $R_1$ represents alkyl, aryl or a ballast group, $R_2$ is a ballast group, alkyl or aryl, Z is hydrogen or a group releasable on reaction with the developer oxidation product, and a compound corresponding to formula (III)

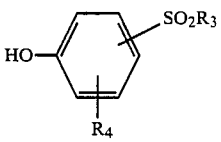

(III)

in which $R_3$ represents alkyl, alkoxy, aryl, optionally substituted amino or the residue of a heterocycle, $R_4$ represents $COR_5$, $NHR_6$, $S(O)_nR_7$ $R_5$ represents $OR_8$, $NHR_8$, alkyl, aryl or a heterocycle, $R_6$ represents $SO_2R_8$, $COR_8$ or $CONHR_8$, $R_7$ represents alkyl, aryl or $NHR_8$, $R_8$ represents alkyl or aryl and n is 0, 1 or 2, with the exception of compounds in which $R_3$ represents a carboxymethoxyphenyl, carboxymethoxy, alkoxycarbonylmethoxy or alkoxycarbonylmethoxyphenyl radical substituted at the methylene group.

2. A color photographic silver halide material as claimed in claim 1, in which Z is halogen, an aryloxy group, an arylthio group or a heterocyclic thio group.

3. A color photographic silver halide material as claimed in claim 1, in which the magenta coupler corresponds to formula (IV)

(IV)

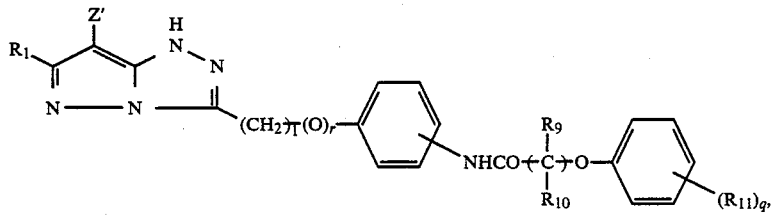

in which

Z′ is a group releasable by reaction with the developer oxidation product, $R_9$ and $R_{10}$ represent hydrogen or alkyl, $R_{11}$ represents alkyl, halogen or hydroxy, l, p and q each have a value of 0 to 4 and r has a value of 0 or 1.

4. A color photographic silver halide material as claimed in claim 3, in which l has a value of 0 to 3, p has a value of 1 to 3 and q has a value of 1 or 2.

5. A color photographic silver halide material as claimed in claim 1, in which the compound corresponds to the following formula

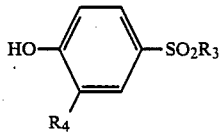

and $R_3$ and $R_4$ are as already defined.

* * * * *